US008961375B2

(12) United States Patent
Henesey

(10) Patent No.: US 8,961,375 B2
(45) Date of Patent: Feb. 24, 2015

(54) SQUAT EXERCISE APPARATUS

(76) Inventor: Brian P. Henesey, Lansdale, PA (US)

( * ) Notice: Subject to any disclaimer, the term of this patent is extended or adjusted under 35 U.S.C. 154(b) by 418 days.

(21) Appl. No.: 13/406,217

(22) Filed: Feb. 27, 2012

(65) Prior Publication Data

US 2012/0220432 A1 Aug. 30, 2012

Related U.S. Application Data

(60) Provisional application No. 61/540,283, filed on Sep. 28, 2011, provisional application No. 61/446,838, filed on Feb. 25, 2011.

(51) Int. Cl.

| | |
|---|---|
| ***A63B 21/062*** | (2006.01) |
| ***A63B 21/065*** | (2006.01) |
| ***A63B 26/00*** | (2006.01) |
| ***A63B 21/072*** | (2006.01) |
| ***A63B 21/075*** | (2006.01) |
| ***A63B 21/078*** | (2006.01) |

(52) U.S. Cl.

CPC ..... *A63B 21/065* (2013.01); *A63B 21/0724* (2013.01); *A63B 21/075* (2013.01); *A63B 21/078* (2013.01); *A63B 2208/0223* (2013.01)

USPC ..... 482/98; 482/105; 482/142

(58) Field of Classification Search

USPC ..... 482/95–99, 102, 105, 123, 129–130, 482/139

See application file for complete search history.

(56) References Cited

U.S. PATENT DOCUMENTS

| | | | | |
|---|---|---|---|---|
| 87,465 | A * | 3/1869 | Butler | 482/94 |
| 4,589,658 | A * | 5/1986 | Gibson | 482/97 |
| 4,890,831 | A * | 1/1990 | Craig | 482/104 |
| 5,158,520 | A | 10/1992 | Lemke et al. | |
| 6,350,220 | B1 * | 2/2002 | Milburn et al. | 482/98 |
| 7,601,101 | B2 * | 10/2009 | Jackson et al. | 482/52 |
| 2006/0003877 | A1 * | 1/2006 | Harmon | 482/142 |

* cited by examiner

*Primary Examiner* — Loan H Thanh
*Assistant Examiner* — Jennifer M Deichl
(74) *Attorney, Agent, or Firm* — Stroock & Stroock & Lavan LLP

(57) ABSTRACT

A squat exercise apparatus for use with a hip belt comprising an elevated platform with a hole, a weight holder and a guide rod or other guide, as disclosed herein. The weight holder may be designed to hold free weights and to attach onto a hip belt. As the user performs the squat exercise supported by the platform, the guide rod guides the weight holder as it is lowered into the hole, limiting movement of the weight holder in the horizontal direction. Alternatively, the apparatus comprises a weight holder and a guide rod and base, for use with a user-supplied platform.

15 Claims, 2 Drawing Sheets

SQUAT EXERCISE APPARATUS

CROSS REFERENCE TO RELATED APPLICATIONS

The present application claims priority to and the benefit of the filing date of U.S. Provisional No. 61/446,838, filed Feb. 25, 2011, and U.S. Provisional No. 61/540,283, filed Sep. 28, 2011, which applications are incorporated herein fully by this reference.

FIELD OF INVENTION

The present invention relates generally to a squat exercise apparatus and, more specifically, to a squat exercise apparatus for use with a hip belt.

BACKGROUND OF THE INVENTION

Squat exercise, which are typically performed with a weighted barbell on the athlete's shoulders, are recognized as a highly beneficial strength training exercise. However, weighted barbell squats can be dangerous, especially for individuals who are susceptible to spinal compression injuries and shoulder impingement. Consequently, squats using weights supported by hip belts have been proposed.

The current modes for performing the squat exercise with a hip belt involve either unstabilized free weights (e.g., U.S. Pat. No. 4,589,658) or a pulley system (e.g., U.S. Pat. No. 5,158,520). These modes have proven subpar both from a safety perspective and a performance perspective.

From a safety perspective, people performing squats with unstabilized free weights often do so in a haphazard manner; for example, by standing up between two weight benches with weights freely swinging between their legs. Any use of pedestals and unrestricted free-weights to perform the squat exercise creates the risk of falling. Pulley systems are typically complicated structures that may be costly to manufacture and maintain, difficult to use and may also involve safety issues. Users of pulley systems enjoy unrestricted horizontal movement, which can create a horizontal pull that, in turn, causes balance issues. Additionally, weights in a pulley system may be loaded and unloaded laterally from the lifting platform and users can injure themselves when loading and unloading the weights.

From a performance perspective, both the machine pulley system and the swing of the free weights make it difficult for users to push their hips back and sit down into the squat, which motion is key to activating all the multiple joints and muscles involved in squats. As a result, both of these methods make the squat a quadricep dominant exercise rather than a multi-joint, multi-muscle exercise.

Accordingly, there is a need for improved equipment for and methods of performing squats.

SUMMARY

Embodiments of the present invention include apparata for performing the squat exercise, preferably using a hip belt, that are both safe and effective. One embodiment has an elevated platform with a hole for receiving weights, a weight holder and a guide rod aligned with the hole. The weight holder is designed to hold standard free weights (but, could alternatively accommodate custom weights) and to attach to a hip belt. The user performs the squat exercise, standing on the platform, with the hole, and weight holder suspended on a hip belt, between his legs. As the user squats down, the guide rod guides the weight holder as it is lowered into the hole and onto the guide rod. The apparatus allows users to push their hips back and "sit" into the squat on a secure platform while the guide rod stabilizes the horizontal movement of the weights. The apparatus also allows for additional key performance exercises such as step-ups, box jumps and additional forms of the squat, offering tremendous multi-purpose benefits.

In alternate embodiments of the invention, the apparatus comprises the weight holder, the guide rod and an attached rod base, with users performing the squat exercise using their own platform(s).

In certain embodiments, the weight holder includes a hollow loading pin and a base, and the hollow loading pin is designed to fit over the guide rod and the base is designed to fit through the hole.

In other embodiments other means for guiding the weights may be used, such as a cylinder extending beneath the hole, dimensioned to receive and guide the weight holder. In certain embodiments both the guide rod and cylinder are used. Where the weight holder has a circular profile, a cylinder may be used to guide the weight holder. Such a cylinder may extend beneath the platform and surround the guide rod, if one is used. The cylinder may be secured by any of a number of ways, including for example, by being form-fit into the hole, being welded around the hole periphery or secured to a base beneath the platform.

Other embodiments may include hand railings for support, a bungee cord for upper body resistance and/or an adjustable-height box squat seat to perform additional exercises.

BRIEF DESCRIPTION OF THE DRAWINGS

The drawings correspond to embodiments of the invention. The figures are merely illustrative and do not limit the invention as claimed. In the drawings:

DETAILED DESCRIPTION OF CERTAIN EMBODIMENTS OF THE INVENTION

Figure 1:
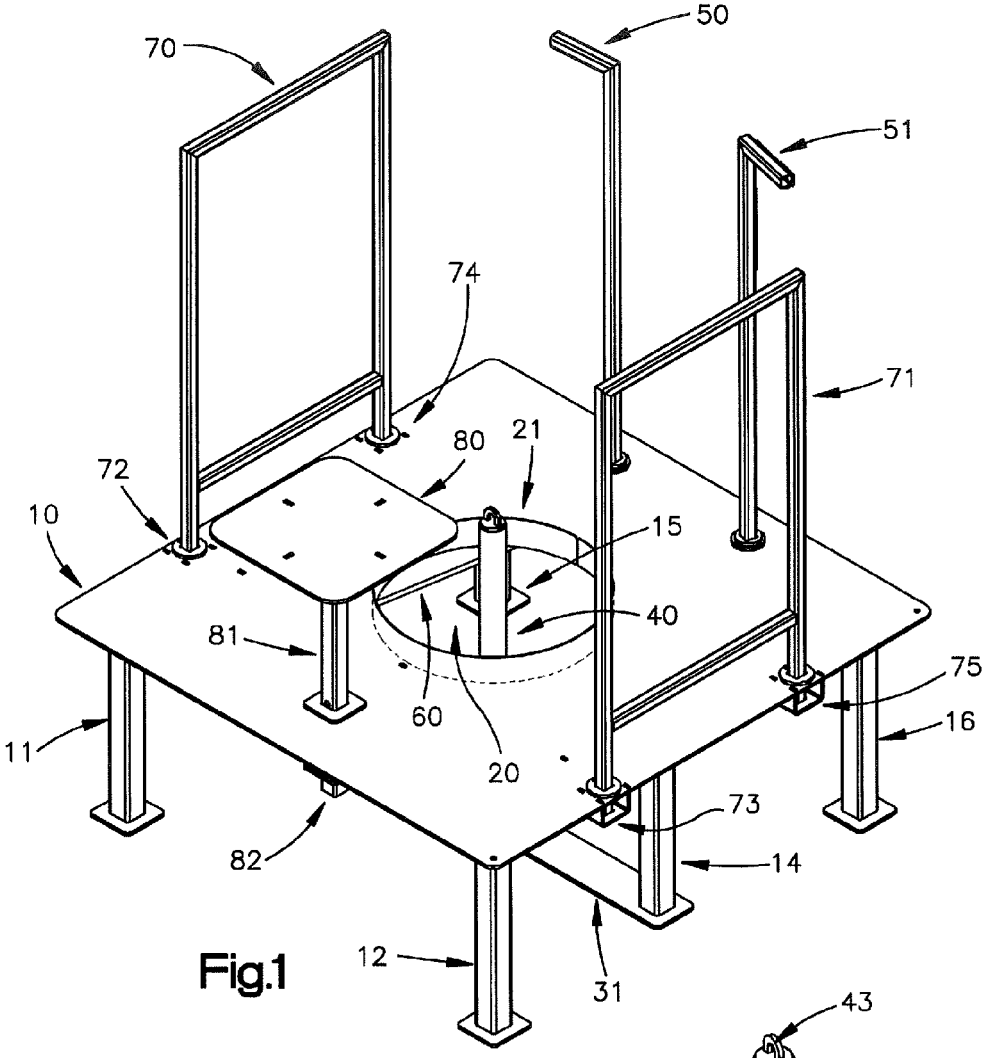
FIG. 1 is a perspective view of one embodiment of the squat exercise apparatus according to the present embodiment.
Figure 2:
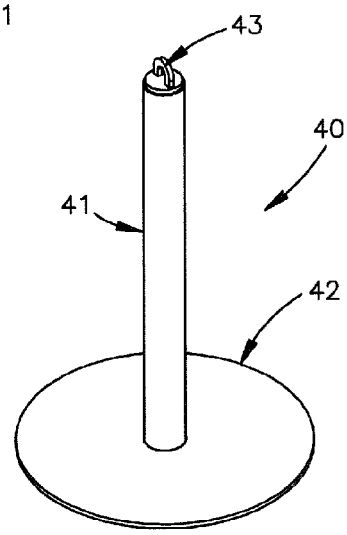
FIG. 2 is a perspective view of the weight holder of the embodiment in FIG. 1.
Figure 3:
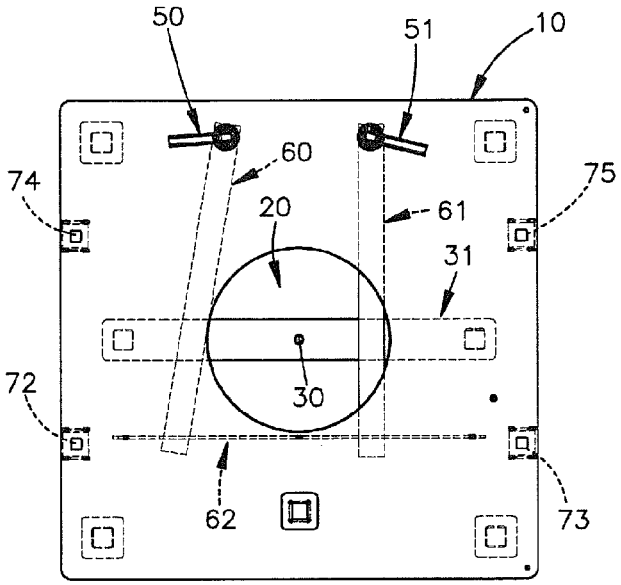
FIG. 3 is a top view of the embodiment in FIG. 1 with the platform transparent and without the side rails, the adjustable-height box squat seat or the weight holder.
Figure 4:
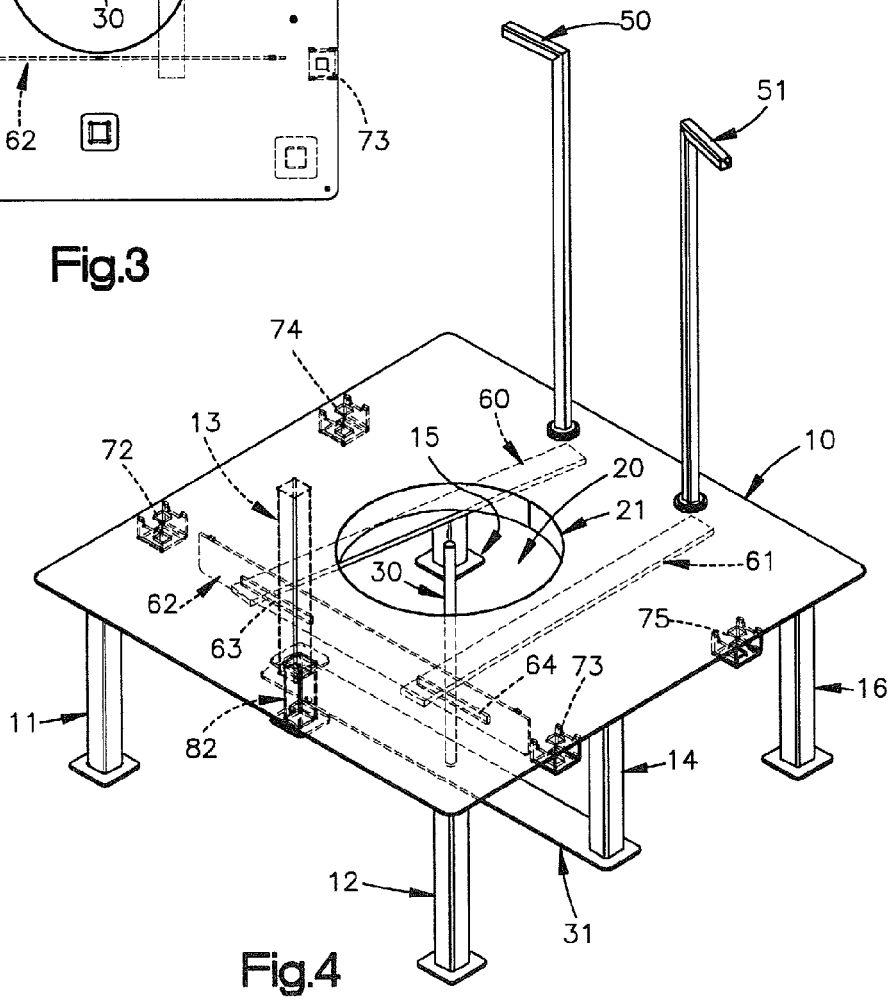
FIG. 4 is a perspective view of the embodiment in FIG. 1 without the side rails or the adjustable-height box squat seat, and showing certain structures in phantom lines.

Certain embodiments of the present invention will now be described with reference to FIGS. 1-4. It should be understood that the invention should not be limited to the structures described or illustrated. In the embodiment depicted in FIGS. 1-4, the squat exercise apparatus includes an elevated platform 10 with a hole 20; a guide rod 30; a weight holder 40; two movable arms 50 and 51, each connected to a loading arm 60 and 61, respectively; two hand rails 70 and 71; and an adjustable-height squat seat 80.

In the embodiment of FIGS. 1-4, the elevated platform 10 is preferably a four foot by four foot, square platform. The platform 10 is preferably made of steel and elevated approximately eighteen inches from the ground by six individual legs 11, 12, 13, 14, 15 and 16. In other embodiments, the platform is elevated by rectangular sleigh legs. Other embodiments may include a platform of a different shape, dimension, material, elevation height and/or with different structures used for elevation.

The hole 20 in the elevated platform is preferably a circular hole, for example, seventeen inches in diameter, positioned in the center of the platform. The hole is so shaped and dimensioned to accept standard thirty-five pound weight plates, each about fourteen inches in diameter. Other embodiments may include a hole of a different size, shape or dimension, or a hole positioned elsewhere in the platform. As will be appreciated by those skilled in the art, the hole 20 may be made smaller in diameter to accommodate users with a narrower stance. In the present embodiment, the hole 20 has a lip 21 extending upwards (e.g. about an inch) around its perimeter to stabilize the weights, prevent excessive swing and help avoid the user accidently stepping into the hole.

In the embodiment of FIGS. 1-4, the guide rod 30 is preferably aligned with the middle of the hole 20 in the platform 10, extending vertically from beneath the platform 10 to slightly above the platform 10 (e.g., an inch). The guide rod 30 is preferably attached to a brace or support 31 beneath the platform that is welded to two middle legs 13 and 14 and that sits on the ground. Other embodiments may include a guide rod positioned differently with respect to the hole, attached to the apparatus in a different manner and/or a guide rod that does not extend above the level of the platform.

In the embodiment of FIGS. 1-4, the weight holder 40 is a hollow loading pin 41 and a base 42. The hollow loading pin 41 allows the weight holder 40 to slide over the guide rod 30. The weight holder 40 is preferably designed for use with a hip belt, for example, releasably affixed via a clasp to an eyelet or hook 43 on the weight holder 40. In the embodiment of FIGS. 1-4, the loading pin 41 is about two inches in diameter, the base 42 is circular and both the loading pin 41 and base 42 are configured to accept standard Olympic weight plates. Other embodiments may include a loading pin of a different diameter, or a set of loading pins of different diameters to give the user varying degrees of freedom of movement. For instance, a wider diameter loading pin on a smaller diameter guide rod would give the user greater freedom of movement to find their natural position with the security of the guide rod to keep the squat from straying too far from the center point. Other embodiments may include a base of a different shape.

Certain alternate embodiments include multiple weight holders, each of different weight (i.e., the weight holder is the weight), so that loading and unloading separate weight plates may be unnecessary. In some such embodiments, weight plates may also be loaded for adjusting the desired weight.

In certain alternate embodiments, the squat exercise apparatus includes an open-top container beneath the platform 10 that form fits into the hole 20, is welded around the perimeter of the hole 20, is an extension of the lip 21, or otherwise is fixed beneath the platform (e.g., secured to base 31), surrounds the guide rod 30 and receives the weight holder 40. The open-top container may be a cylinder, or any other shape dimensioned to receive the weight holder. The container is preferably dimensioned to easily accommodate the weight holder while still functioning to guide the weight holder and prevent excessive horizontal swing of the weights. The container may be included in addition to the guide rod, or in lieu of the guide rod.

In the embodiment of FIGS. 1-4, the two rotatable arms 50 and 51 above the platform 10 extend down through the platform 10, and each connects to a loading arm 60 and 61, respectively. A guide 62 secured to the underside of the platform 10 has two slits 63 and 64 through which the loading arms 60 and 61 pass and in which they sit. Rotation of the arms 50 and 51 control the positions of the loading arms 60 and 61, shifting them inward, within the hole 20 where they can support the weight holder 40 to load weights, and outward, outside the hole 20, so that a user may perform the squat exercise. This allows users to load weights with the weight holder 40 aligned with the hole 20 and centered on the guide rod 30, rather than, e.g., below the platform 10 or on a separate part of the platform 10, which may cause injury. The arms 50 and 51 are preferably positioned along an edge of the platform, in front of the user performing the squat exercise. Other embodiments may include arms placed in different positions relative to the user, or may omit them.

The two hand rails 70, 71 are preferably along the left and right sides of the platform 10. The "sides" are relative to the user performing the squat exercise. The handrails 70,71 are preferably removably affixed to the platform with removable rail clamps 72, 73, 74 and 75, screws or other attachment means. Other embodiments may include one or more hand railings affixed to the platform in another manner and/or placed at different positions relative to the platform; for instance, in one embodiment, a single hand rail is placed along the same edge as the arms 50, 51.

The embodiment of FIGS. 1-4 also includes the adjustable-height box squat seat 80, which is preferably positioned behind the user performing the squat exercise. The seat 80 is preferably height-adjustable. For example, seat 80 may be supported by support 81, which is slidably supported through the platform 10 by a guide 82 (not shown). The use of guide holes in the support 81 and guide 82 and a support pin allow for adjustment of the seat height. The seat 80 may be square with rounded edges. The box squat seat 80 allows users to perform additional exercises such as the box squat exercise. Other embodiments may include an adjustable-height box squat seat positioned differently on the platform, with a seat of a different shape and/or with a different type of rod.

In another embodiment, the squat exercise apparatus includes one or more bungee cords (not shown) releasably secured to the platform 10 (e.g., by eye-hooks and clasps) to provide upper body resistance.

Alternate embodiments need not include the platform, comprising the weight holder 40, the guide rod 30 and a base for the guide rod, such as base 31 in the embodiment of FIGS. 1-4. In this embodiment, the user performs the squat exercise standing atop their own platform (e.g., two boxes) with the guide rod 30 keeping the weights from swinging excessively. Such an embodiment may include a cylinder that encloses the guide rod or may be in lieu of the guide rod, stabilizing the weight holder itself.

Users may perform the squat exercise in the following manner. A user begins by placing the moveable arms 50 and 51 in the first, closed or "loading" position, such that the loading arms 60 and 61 are within the hole 20 of the platform 10. The user places the unloaded weight holder 40 onto the loading arms 60 and 61, and aligned with the hole 20. The user then loads the weights onto the weight holder 40. Next, the user, wearing a hip belt, stands on the platform 10 with feet positioned at either side of the hole 20, preferably facing the movable arms 50 and 51, and hook their hip belt onto the eyelet or hook 43 of the weight holder 40. Supporting the hip-belt and weight holder 40, the user then moves the movable arms 50 and 51 into their second, open "exercising" position, shifting the loading arms 60 and 61 outside the hole and releasing the weight holder 40. With his/her hands able to be placed on the hand rails 70 and 71 for extra support, the user bends their knees with their hips pushed back and the weight holder 40 is lowered through the hole 20 and beneath the platform 10, guided by the guide rod 30 (and/or the container) to prevent excessive horizontal swing. Once the user is in the full squat position, with hips back and knees bent, he/she stand back up, the guide rod 30 (and/or container)

again guiding the weights and preventing excessive horizontal swing. When finished with a set of squats, the user, while in the standing position, may move the movable arms 50 and 51 back into their second, closed position, shifting the loading arms 60, 61 back within the hole 20 to support the weight holder 40. With the weight holder 40 resting on the loading arms 60, 61, the user can disengage the hip belt from the weight holder 40 and unload the weights from the weight holder 40.

It should be understood that those of ordinary skill in the art will recognize modifications and substitutions may be made to various elements of the present invention. For example, various features and/or elements have been described in connection with the preferred embodiments, which have not been described in another preferred embodiment. It is envisioned that these features and/or elements are interchangeable such that a feature or element described in one embodiment may be used in combination with another embodiment.

Furthermore, it will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the present description, including those of the provisional patent applications referred to herein.

I claim:

1. A squat exercise apparatus for use with a hip belt to be worn by a user performing a squat exercise, the apparatus comprising:

a weight holder attachable to the hip belt;

an elevated platform with a hole for receiving the weight holder;

a guide rod aligned with the hole, at least a portion of the guide rod being disposed below the platform;

wherein when the user performs the squat exercise:

the weight holder is lowered into the hole and beneath the elevated platform; and the weight holder is guided by the guide rod as the weight holder is moved relative to the guide rod and beneath the elevated platform.

2. The squat exercise apparatus of claim 1, wherein:

the weight holder comprises a hollow loading pin and a base connected thereto for receiving weights, the hollow loading pin being dimensioned to receive the guide rod therein and the base being dimensioned to fit through the hole.

3. The squat exercise apparatus of claim 2, wherein:

the hollow loading pin has an interior dimension;

the guide rod has an exterior dimension;

wherein, the interior dimension is greater than the exterior dimension, such that the user is provided freedom of horizontal movement when performing the squat exercise.

4. The squat exercise apparatus of claim 1, further comprising:

an open-top form aligned with the hole and extending beneath the platform.

5. The squat exercise apparatus of claim 1, wherein the hole has a perimeter, the apparatus further comprising:

a lip extending upwards around the perimeter of the hole.

6. The squat exercise apparatus of claim 1, further comprising:

hand railings on at least one side of the platform.

7. The squat exercise apparatus of claim 1, further comprising:

one or more bungee cords secured to the platform.

8. The squat exercise apparatus of claim 1, further comprising:

a box squat seat supported above the platform.

9. A squat exercise apparatus for use with a hip belt to be worn by a user performing a squat exercise, the apparatus comprising:

means for supporting a user having an opening therein;

means for carrying weight and connecting to the hip belt, the means for carrying dimensioned to fit in the opening; and means for guiding the mean for carrying, at least a portion of the means for guiding being disposed below the means for supporting;

wherein, when the user performs the squat exercise:

the means for carrying is guided in a generally vertical direction by the means for guiding as the means for carrying is moved relative to the means for guiding; and the means for carrying is lowered into the opening and beneath the means for supporting.

10. The squat exercise apparatus of claim 9, wherein the means for carrying includes a hollow loading pin and a base connected thereto for receiving weights, the hollow loading pin being dimensioned to engage the means for guiding, thereby guiding the means for carrying when moving relative to the means for guiding, and the base being dimensioned to fit into the opening.

11. The squat exercise apparatus of claim 9, wherein the means for guiding includes an open-top form for receiving the means for carrying.

12. The squat exercise apparatus of claim 9, wherein the means for guiding limits horizontal movement of the means for carrying.

13. The squat exercise apparatus of claim 9, wherein the means for carrying has a first dimension;

the means for guiding has a second dimension;

wherein, the first dimension is different than the second dimension, such that the user is provided freedom of horizontal movement when performing the squat exercise.

14. The squat exercise apparatus of claim 13, wherein the means for carrying includes a base and the first dimension is an exterior dimension of the base; and the means for guiding includes an open-top form aligned with the hole and the second dimension is an interior dimension;

wherein the base is provided freedom of horizontal movement within the open top form when the user performs the squat exercise.

15. The squat exercise apparatus of claim 13, wherein the means for carrying includes a base having a cavity and the first dimension is an interior dimension of the cavity; and the means for guiding includes a guide rod aligned with the hole and the second dimension is an exterior dimension of the guide rod;

wherein the base is provided freedom of horizontal movement with relation to the guide rod when the user performs the squat exercise.

* * * * *